US005437744A

United States Patent [19]

Carlen

[11] Patent Number: 5,437,744

[45] Date of Patent: Aug. 1, 1995

[54] MOLYBDENUM-RHENIUM ALLOY

[75] Inventor: Jan C. Carlen, Elyria, Ohio

[73] Assignee: Rhenium Alloys, Inc., Elyria, Ohio

[21] Appl. No.: 10,389

[22] Filed: Jan. 28, 1993

[51] Int. Cl.[6] ..... C22C 27/04

[52] U.S. Cl. ..... 148/423; 420/429

[58] Field of Search ..... 420/429; 148/423

[56] References Cited

U.S. PATENT DOCUMENTS 5,263,349 11/1993 Felix et al. ..... 72/38

FOREIGN PATENT DOCUMENTS 1182842 12/1964 Germany .
816135 7/1959 United Kingdom .
873837 7/1961 United Kingdom .
1195740 6/1970 United Kingdom .

OTHER PUBLICATIONS

R. Elliott, "Constitution of Binary Alloys, First Supplement," 1970, McGraw-Hill Book Company, New York, pp. 628 and 629.

T. Massalski, "Binary Alloy Phase Diagrams, vol. 2," 1987, American Society for Metals, Metals Park, Ohio, pp. 1622 and 1623.

Powder Processing and the Fabrication of Rhenium, Reprint from JOM, vol. 43, No. 7, Jul. 1991, pp. 24–26.

Evaluation of Properties and Special Features for High--Temperature Applications of Rhenium; American Institute of Physics, 1992, Jan. 12–16.

*Primary Examiner*—Melvyn J. Andrews
*Assistant Examiner*—Sikyin Ip
*Attorney, Agent, or Firm*—Burns, Doane, Swecker & Mathis

[57] ABSTRACT

A molybdenum-rhenium alloy having an excellent low temperature ductility paired with an excellent high temperature strength. The alloy consists, essentially in % by weight, of 42 up to <45% Re, up to 3% each of W, Y, Rh, Sc, Si, Ta, Tb, V, Nb or Zr at which the sum of said elements is no greater than about 5%, the remainder being Mo besides normally present impurities.

13 Claims, No Drawings

MOLYBDENUM-RHENIUM ALLOY

BACKGROUND OF THE INVENTION

Among the high-temperature alloys based on refractory metals for aero-space and nuclear applications, etc., various tungsten- and molybdenum-alloys containing high amounts of rhenium have been considered and used for a long time. Thus, it is known that the properties of such alloys are greatly improved by the so-called "rhenium effect", which means i.a., that a rhenium addition simultaneously improves strength, plasticity and weldability; lowers the ductile-to-brittle transition temperature of wrought products; and reduces the degree of recrystallization embrittlement.

The greatest improvement in properties are obtained with additions of 11 to 50 wt % Re in the case of Mo. Particularly useful alloys have been found in the range of 40–50 wt % Re and two commercial alloys have the compositions Mo-41 wt % Re and Mo-47.5 wt % Re.

With ever increasing demands and requirements upon the engineering and structural materials, it has been shown, however, that the alloy with 41% Re has a ductile to brittle transition temperature of about −150° C. (about 125K) which is too high for most space applications. Furthermore, the alloy with 47.5% Re corresponds to a supersaturated solution of Re in Mo and when exposed to temperatures between about 1075°–1275° C. (about 1350–1550K) an embrittling sigma ($\sigma$) phase (Mo Re) will be precipitated-decreasing the otherwise excellent low temperature ductility to the same order of magnitude as for the Mo-41 wt % Re.

Consequently, neither of the two above described Mo-Re alloys nor any other known Mo-Re alloy fulfills the requirements in the aero-space applications regarding said kind of material being necessary today.

Old technical information on Re-Mo alloys exists in the literature, but there are several incorrect data included, which makes it difficult to interpret the information in an accurate way. Thus, there are phase diagrams indicating that the sigma phase does not exist at temperatures below about 1150° C. (about 1425K). The fact, is, however, that the sigma phase is stable down to OK (−273° C.) but does not form in reasonable time periods at temperatures below about 1125° C. (about 1400K) because of slow diffusion rates. Furthermore, there are old data regarding the effect of rhenium alloying on the ductile-to-brittle bend transition temperature of molybdenum showing that, e.g., Mo-50 Re has a constant ductile behavior, while Mo-45 Re has an average ductile-to-brittle transformation temperature of about −180° C. (about 95K). Said data do not take into consideration, however, that Mo-alloys with more than about 45% Re may get embrittled in welding and other joining processes, used in fabricating components.

FIELD OF THE INVENTION

The present invention relates to a molybdenum-rhenium alloy for applications where a good low temperature ductility must be paired with good high temperature strength.

In particular, the molybdenum-rhenium alloy according to the invention can be used for aero-space applications and similar uses which require a ductile to brittle transition temperature at least lower than about −180° C. (about 95K), preferably lower than about −190° C. (about 85K) or more preferably lower than about −200° C. (about 75K) as well as an excellent structural stability at temperatures up to about 1500° C. (about 1775K) (i.e., the material is free of embrittling phases such as sigma phase).

OBJECT OF THE INVENTION

It is an object of the present invention to obtain a material such as a molybdenum-rhenium alloy which does not show the above-mentioned disadvantages of the known Mo-Re alloys such as Mo-41 Re and Mo-47.5 Re but which must have all the beneficial properties of said alloys and thereto be possible to produce at no additional costs or difficulties.

SUMMARY OF THE INVENTION

According to the invention there is now available a molybdenum-rhenium alloy which fulfills the earlier mentioned requirements and thereto shows further improvements of the properties compared to earlier known Mo-Re alloys. The alloy according to the invention consists essentially, in % by weight, of 42 up to <45% Re, up to 3%, preferably up to 1% each of W, Y, Rh, Sc, Si, Ta, Tb, Vb, V or Zr, at which the sum of said elements is no greater than about 5%, preferably 3%, the remainder being Mo besides normally present impurities.

It has surprisingly been found that the alloy of the invention combines the excellent structural stability of the Mo 41 wt % Re alloy, i.e., no embrittling sigma-phase is formed, with a sufficiently low ductile-to-brittle transition temperature, such as at least below about −180° C. (about 95K), preferably below about −190° C. (about 85K) or more preferably below −200° C. (about 75K). In all other respects, its properties are similar to or superior to those of the Mo 41 wt % Re and Mo 47.5 wt % Re alloys.

In order to obtain a sufficient ductility at very low temperatures, the content of rhenium should be at least 43%, preferably at least 43.5%, and more preferably at least 44 wt % Re.

In order to reduce the risks of precipitation of embrittling sigma phase at high temperatures, such as 1100°–1500° C., the content of rhenium should be less than about 45%, preferably ≦44.8%.

It has been found that a particularly advantageous Mo-Re alloy consists in % by weight of 44.5±0.5% Re and 55.5±0.5% Mo besides normally present impurities. Preferably, the content of rhenium should be lower than 44.7% by weight.

DETAILED DESCRIPTION OF THE INVENTION

Fabrication of the alloy according to the invention is preferably performed by conventional powder metallurgical methods such as those described in the literature (see e.g. *JOM*, Vol. 43, No. 7, July, 1991, pp. 24–26).

It has been found that mechanically blended powder of Mo and Re usually will give completely satisfactory results in the subsequent fabrication of the alloy according to the invention. This is advantageous compared to the fabrication of Mo-alloys having a somewhat higher content of Re, such as Mo-47.5% Re, at which precoated powders (e.g. precoated Mo powder) have often been considered necessary in order to improve the structural stability of the alloy, i.e., to decrease or eliminate the presence of the intermetallic sigma phase, which seriously affects mechanical properties even when present in small amounts.

Basic components such as strip, bar, tubing, wire, etc. of the alloy according to the invention can be made by the fabrication processes described in the above-mentioned literature as well as in e.g., ASM's "Advanced Materials & Processes", pp. 22–27, 9/1992. Further details are disclosed in e.g. "Proceedings of the Ninth Symposium on Space Nuclear Power Systems," pp. 278–291, Albuquerque, N. Mex., January 1992.

The alloy according to the invention is preferably used for components which are subjected to temperatures below −180° C., often below −200° C. and temperatures above 1200° C., often above 1300° C. or 1400° C. during use of the component. Examples of such applications are components in aero-space vehicles, in which, e.g. some engine parts are heated to very high temperatures during various periods, but subjected to very low temperatures during other periods. On the other hand, when components made of Mo-Re alloys with Re contents ≧45% are subjected to temperature fluctuations of ≦−180° C. to ≧1200° C., there is a risk of forming embrittling sigma phase at temperatures at or above 1200° C. which could lead to fracture when the component is cooled to or below −180° C. Mo-Re components with <42% Re exhibit poor ductility at such low temperatures.

The following examples show the results of testing the low temperature ductility and the structural stability of an alloy according to the invention.

EXAMPLE 1

Tensile specimens for testing of Mo-Re sheet were made of an alloy consisting of 55.5% Mo and 44.5% Re.

The original gage dimensions were about 0.02×0.2 inches and the original gage length about 0.5 inch. Tests were performed at −320° F. (−196° C.) and −200° F. (−129° C.).

RESULTS

The following results were obtained in the tensile test (see Table 1).

TABLE 1

| Temp. (°F.) | Tensile strength (psi) | 0.2% yield strength (psi) | Elongation (%) |
|---|---|---|---|
| −320 | 183840 | 162396 | 4.0 |
| −320 | 180818 | 156756 | 4.0 |
| −200 | 189460 | 163690 | 26.0 |
| −200 | 199312 | 161081 | 24.0 |

The results show that an acceptable, very good ductility for this kind of material was obtained even at the lowest test temperature.

EXAMPLE 2

Five Mo-Re alloy compositions Nos. 1, 2, 3, 4 and 5 were produced from powders by compaction and sintering, after which the sintered bars were submitted to rolling to a thickness of 0.020" by a series of reductions and intermediate annealings.

After annealing in a hydrogen atmosphere furnace, some sheet samples were electron beam welded and tested. The chemical composition and metal powder production conditions are given in Table 2.

TABLE 2

| Alloy No. | Composition wt % | Production conditions |
|---|---|---|
| 1 | 55.5/Mo/44.5 Re | Mechanically blended standard powder |
| 2 | 53.0 Mo/47.0 Re | Precoated double reduction powder |
| 3 | 53.0 Mo/47.0 Re | Precoated single reduction powder |
| 4 | 52.5 Mo/47.5 Re | Precoated single reduction powder |
| 5 | 52.5 Mo/47.5 Re | Mechanically blended standard powder |

Measurements of density of the sintered bars were carried out in accordance with ASTM B328. The homogeneity of the density was determined by Rockwell Hardness Testing (Scale A) in accordance with ASTM E18-92.

Metallographic examinations such as e.g. microscopic observations of the welded area and evaluation of the microstructure in cross sections were performed in accordance with ASTM E3-80 and ASTM E112-88.

RESULTS

The sintered flat bars showed good density, 95.5%–96.2% of theoretical, for all the alloys.

The areas of Mo/44.5 Re (the alloy according to the invention) and of Mo/47 Re precoated (alloys No. 1–3) were free of any sigma phase. Standard alloy Mo/47.5 Re (alloy No. 5) showed equally distributed sigma phase in a quantity of 8–10% by volume. Alloy Mo/47.5 Re (alloy No. 4) showed equally distributed sigma phase in 2–3% by volume.

Metallographic examinations of electron beam welded sheet such as microscopic observations of the weld area showed porosity and significant voids in the weld area of the coated powder materials produced (i.e., the alloys No. 2, 3 and 4). These defects were not found in any of the mixed powder materials, etched or unetched (i.e., the alloys No. 1 and 5).

Consequently, the only one of the alloys tested which showed the presence of neither sigma phase nor porosity nor voids was the alloy No. 1, i.e., the alloy 55.5 Mo/44.5 Re according to the invention.

Thus, the alloy according to the invention showed superior properties as well as lower production costs (precoating of powder is time consuming and complicated) and lower raw material costs (the price ratio of Re/Mo is about 200/1).

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A worked and recrystallized molybdenum-rhenium alloy having an excellent low temperature ductility paired with an excellent high temperature strength, said Mo-Re alloy being free of sigma phase and consisting essentially, in % by weight, of 42 up to <45% Re, up to 3% each of W, Y, Rh, Sc, Si, Ta, Tb, V, Nb or Zr, at which the sum of said elements is no greater than about 5%, the remainder being Mo besides normally present impurities.

2. The Mo-Re alloy according to claim 1, wherein the content of rhenium is at least 43%.

3. The Mo-Re alloy according to claim 1, wherein the content of rhenium is at least 43.5%.

4. The Mo-Re alloy according to claim 1, wherein the content of rhenium is no greater than about 44.8%.

5. The Mo-Re alloy according to claim 1, wherein the content of rhenium is less than 44.7%.

6. The Mo-Re alloy according to claim i, wherein the alloy consists of 44.5±0.5% Re and 55.5±0.5% Mo besides normally present impurities.

7. The Mo-Re alloy according to claim 1, wherein the sum of W, Y, V, Rh, Sc, Si, Ta, Tb, Nb and Zr is no greater than about 3%.

8. The Mo-Re alloy according to claim 1, wherein the content of each of W, Y, V, Rh, Sc, Si, Ta, Tb, Nb and Zr is no greater than about 1%.

9. The Mo-Re alloy according to claim 1, wherein the alloy is produced from a mechanically blended powder.

10. The Mo-Re alloy according to claim 1, wherein the alloy is a component which is subjected to temperatures below −180° C. and above 1200° C. during use of the component.

11. The Mo-Re alloy according to claim 1, wherein the alloy has an average ductile-to-brittle transition temperature below about −180° C.

12. The Mo-Re alloy according to claim 1, wherein the alloy has an average ductile-to-brittle transition temperature below about −200° C.

13. A worked and recrystallized molybdenum-rhenium alloy having an excellent low temperature ductility paired with an excellent high temperature strength, said Mo-Re alloy being free of sigma phase and consisting essentially, in % by weight, of 42 up to <45% Re, the remainder being Mo besides normally present impurities.

* * * * *